US008336343B2

(12) United States Patent
Chung et al.

(10) Patent No.: US 8,336,343 B2
(45) Date of Patent: Dec. 25, 2012

(54) WASHING MACHINE HAVING REMAINING WATER DISCHARGE PASSAGE

(75) Inventors: Seung Hwan Chung, Suwon-si (KR); Myung Sun Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 496 days.

(21) Appl. No.: 12/585,043

(22) Filed: Sep. 1, 2009

(65) Prior Publication Data

US 2010/0175727 A1 Jul. 15, 2010

(30) Foreign Application Priority Data

Jan. 9, 2009 (KR) ..... 10-2009-0001857

(51) Int. Cl.

| | |
|---|---|
| ***D06F 39/04*** | (2006.01) |
| ***D06F 39/08*** | (2006.01) |
| ***D06F 29/00*** | (2006.01) |
| ***D06F 35/00*** | (2006.01) |
| ***D06F 37/00*** | (2006.01) |
| ***D06F 39/00*** | (2006.01) |

(52) U.S. Cl. ..... 68/208; 68/12.19; 68/13 R

(58) Field of Classification Search ..... 68/12.19, 68/13 R, 208

See application file for complete search history.

(56) References Cited

U.S. PATENT DOCUMENTS 3,556,446 A * 1/1971 Bochan ..... 248/638
7,251,963 B2 * 8/2007 Kim et al. ..... 68/196
2005/0274158 A1 * 12/2005 Kim ..... 68/19

FOREIGN PATENT DOCUMENTS

| | | | |
|---|---|---|---|
| JP | 10085488 | A * | 4/1998 |
| JP | 2001050585 | A * | 2/2001 |
| KR | 20-1997-62496 | | 12/1997 |
| KR | 10-2004-0026888 | | 4/2004 |
| KR | 2006007464 | A * | 1/2006 |
| KR | 10-2007-0113432 | | 11/2007 |
| KR | 2008002469 | A * | 1/2008 |
| KR | 2008018664 | A * | 2/2008 |
| KR | 2008022793 | A * | 3/2008 |

OTHER PUBLICATIONS

KR 2006-007464 Machine Translation Jan. 2006 Korea Choi et al.*
KR 2006-007464 Foreign Patent Jan. 2006 Korea Choi et al.*

* cited by examiner

*Primary Examiner* — Michael Barr
*Assistant Examiner* — Charles W Kling
(74) *Attorney, Agent, or Firm* — Staas & Halsey LLP

(57) ABSTRACT

An automatic washing machine includes a remaining water discharging passage to drain remaining water from a pump case by connecting a drain line with an inner part of the pump case. The washing machine includes a water tub; a pump case; a circulation pump coupled with the pump case that circulates washing water contained in the water tub; a drain line to drain the washing water contained in the water tub; and a remaining water discharge passage connecting an inner part of the pump case with the drain line to discharge water remaining in the pump case.

11 Claims, 6 Drawing Sheets

WASHING MACHINE HAVING REMAINING WATER DISCHARGE PASSAGE

CROSS-REFERENCE TO RELATED APPLICATION

This application claims the benefit of Korean Patent Application No. 10-2009-0001857, filed on Jan. 9, 2009, in the Korean Intellectual Property Office, the disclosure of which is incorporated herein by reference.

BACKGROUND

1. Field

The disclosure relates to a washing machine. More particularly, the disclosure relates to a washing machine capable of forming a remaining water discharge passage to drain remaining water from a pump case by connecting a drain line with an inner part of the pump case equipped with a circulation pump that circulates washing water contained in a water tub.

2. Description of the Related Art

In general, a washing machine includes a water tub, a circulation passage used to circulate washing water contained in the water tub, and a drain line used to drain washing water contained in the water tub.

The circulation passage includes a guide passage used to guide washing water introduced through an inlet positioned at a lower portion of the water tub, a circulation pump installed in a pump case to pump the washing water to an upper portion of the water tub, and a discharge passage used to guide washing water pumped from the pump case to the upper portion of the water tub.

In addition, the drain line includes a washing water outlet positioned at a lower portion of the water tub, a drain pipe used to guide washing water, which has been drained from the washing water outlet, to an exterior, and a drain valve installed in the drain pipe to open/close the drain line.

SUMMARY

Accordingly, it is an aspect of the present embodiments to provide a washing machine capable of draining water remaining in a pump case equipped with a circulation pump through a drain line.

It is another aspect to provide a washing machine that drains remaining water in the pump case through the drain line by forming a remaining water discharging passage connecting the pump case equipped with the circulation pump to the drain line.

Additional aspects and/or advantages will be set forth in part in the description which follows and, in part, will be apparent from the description, or may be learned by practice of the disclosure.

The foregoing and/or other aspects may be achieved by providing a washing machine including a water tub, a pump case, a circulation pump coupled with the pump case that circulates washing water contained in the water tub, a drain line to drain the washing water contained in the water tub, and a remaining water discharge passage connecting an inner part of the pump case with the drain line to discharge water remaining in the pump case.

The remaining water discharge passage includes a first remaining water discharging port formed at one side of the pump case, a second remaining water discharging port formed at one side of the drain line, and a remaining water discharging pipe connecting the first and second remaining water discharging ports with each other.

The washing machine further includes a drain valve installed in the drain line to open/close the drain line, in which the drain line includes a front drain line connecting the water tub to the drain valve and a rear drain line connecting the drain valve to an exterior.

The second remaining water discharging port is formed at one side of the front drain line. The first remaining water discharging port is formed at a lower portion of the pump case. The first remaining water discharging port is formed at a side surface of the pump case.

The pump case, the remaining water discharge passage, and the front drain line are integrated with each other. The remaining water discharge passage is declined from the pump case to the drain line. The second remaining water discharging port is lower than the first remaining water discharging port. The circulation pump is fixed to a lower portion of the water tub.

The foregoing and/or other aspects may also be achieved by providing a washing machine including a water tub, a pump case, a circulation pump coupled to the pump case that circulates washing water contained in the water tub, a remaining water discharging pipe formed at one side of the pump case, a drain line allowing the washing water contained in the water tub to be discharged, and a drain valve installed in the drain line to open/close the drain line, the drain line including a front drain line extending from the water tub to the drain valve and a rear drain line extending from the drain valve to an exterior of the washing machine, and the remaining water discharging pipe is connected with one side of the front drain line so that water remaining in the pump case flows through the front drain line.

The remaining water discharging pipe is formed at a lower portion of a side surface of the pump case.

The foregoing and/or other aspects may also be achieved by providing a washing machine including a water tub, a circulation line allowing washing water contained in the water tub to circulate, a drain line spaced apart from the circulation line such that the washing water contained in the water tub drains according to gravity, and a pump case installed in the circulation line and including a circulation pump, in which the pump case communicates with the drain line to discharge water remaining in the pump case.

The washing machine further includes a drain valve installed in the drain line to open/close the drain line, in which the drain line includes a front drain line extending from the water tub to the drain valve, and a rear drain line extending from the drain valve to an exterior, and the pump case communicates with the front drain line.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION OF EMBODIMENTS

Figure 1:
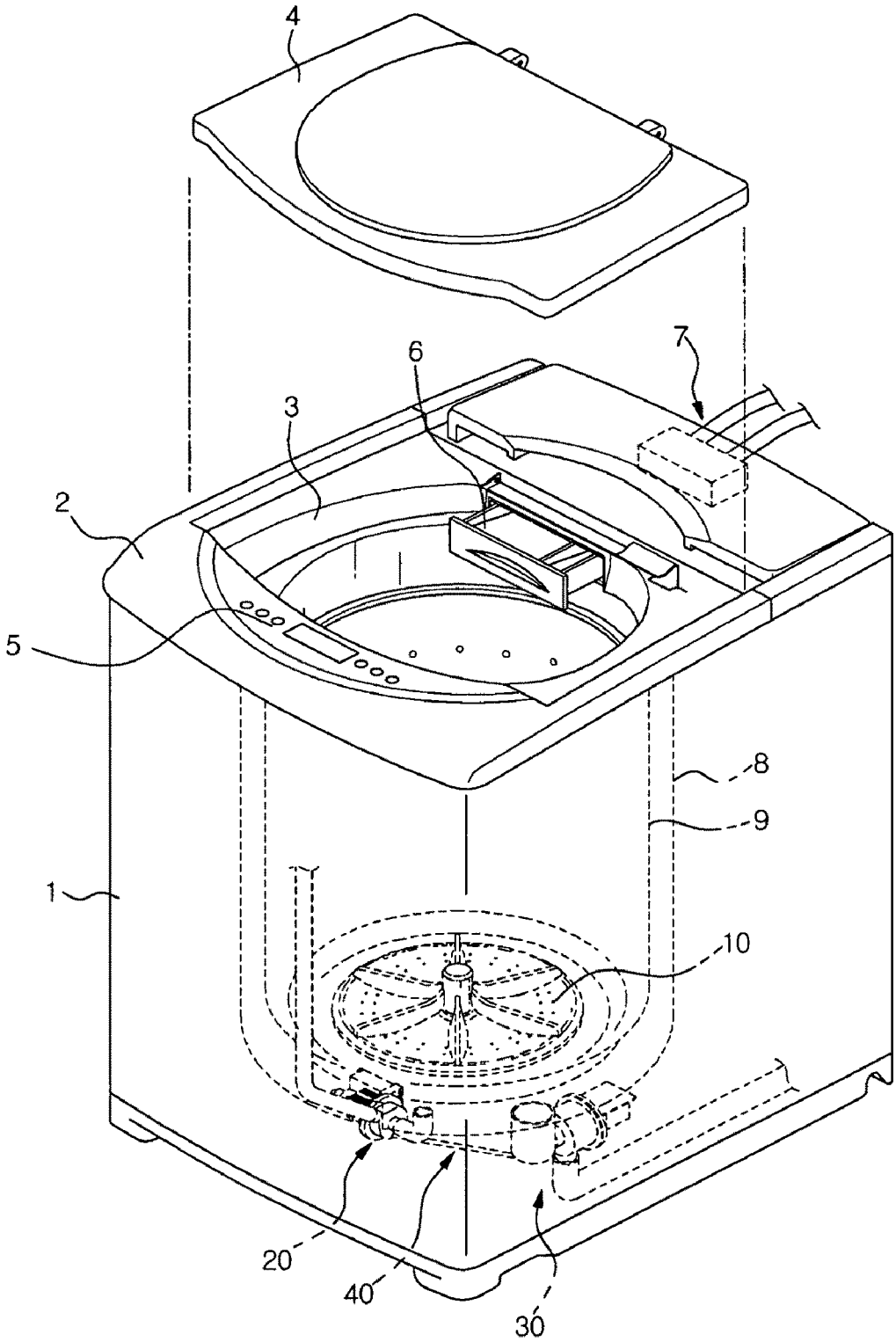
FIG. 1 is a perspective view schematically showing the structure of an automatic washing machine according to an embodiment of the present invention.

Reference will now be made in detail to the embodiments, examples of which are illustrated in the accompanying drawings, wherein like reference numerals refer to the like elements throughout. The embodiments are described below to explain the present embodiments by referring to the figures.

Hereinafter, exemplary embodiments will be described in detail with reference to accompanying drawings. According to the embodiment, an automatic washing machine will be representatively described below.

FIG. 1 is a perspective view schematically showing an automatic washing machine according to the embodiment.

As shown in FIG. 1, the automatic washing machine according to the embodiment includes a cabinet forming a body and an upper panel 2 installed at an upper portion of the cabinet 1.

The upper panel 2 is provided at a central portion thereof with an opening 3 allowing a user to put laundry into the washing machine or take laundry out of the washing machine. The opening 3 is opened by a door 4 pivotally mounted on the upper panel 2. The upper panel 2 is provided at a front portion thereof with a control panel 5 to control the automatic washing machine. The door 4 is provided at a lower portion thereof with a detergent box 6 to contain detergents therein. A rear portion of the detergent box 6 is connected with a water supply device 7 to supply washing water to the automatic washing machine.

The cabinet 1 is provided therein with a water tub 8 to contain washing water. A rotating tub 9 is rotatably installed in the water tub 8. A pulsator 10 is rotatably mounted on a bottom surface of the water tub 8 to form a spiral water flow. Provided at the lower portion of the water tub 8 are a clutch (not shown) and a driving motor (not shown) to apply rotational force to the pulsator 10 and the rotating tub 9.

Accordingly, if a user sets a desired washing function through the control panel 5, a water flow is generated due to the rotation of the pulsator 10, so that the automatic washing machine can wash laundry.

In order to enhance wash efficiency, such an automatic washing machine includes a circulation passage 20 used to pump washing water contained in the water tub 8 and then drop the washing water into the rotating tub 9, thereby exerting impact on laundry.

In addition, the automatic washing machine is provided therein with a drain line 30 spaced apart from the circulation passage 20 such that washing water contained in the water tub 8 is drained to the outside after the laundry has been washed. The automatic washing machine includes a remaining water discharge passage 40 connecting the circulation passage 20 with the drain line 30.

The structure of the circulation passage 20, the drain line 30, and the remaining water discharge passage 40 will be described in detail later.

Figure 2:
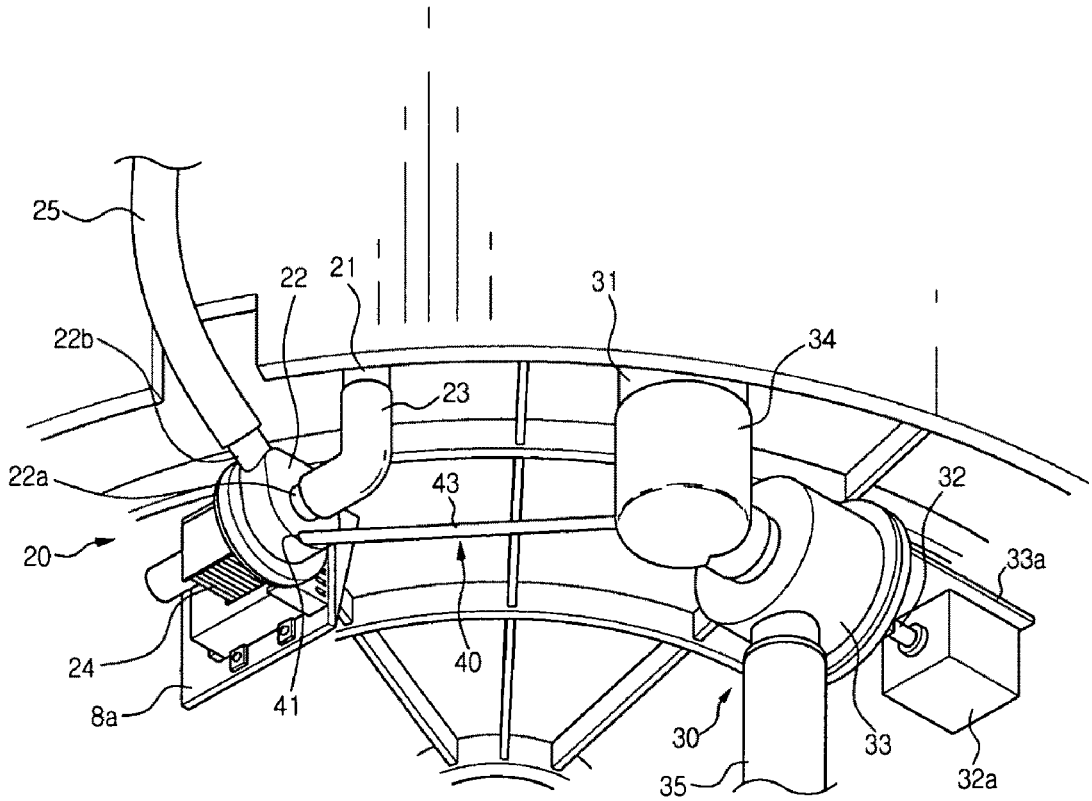
FIG. 2 is a perspective view showing the structure of the automatic washing machine according to the embodiment of FIG. 1.
Figure 3:
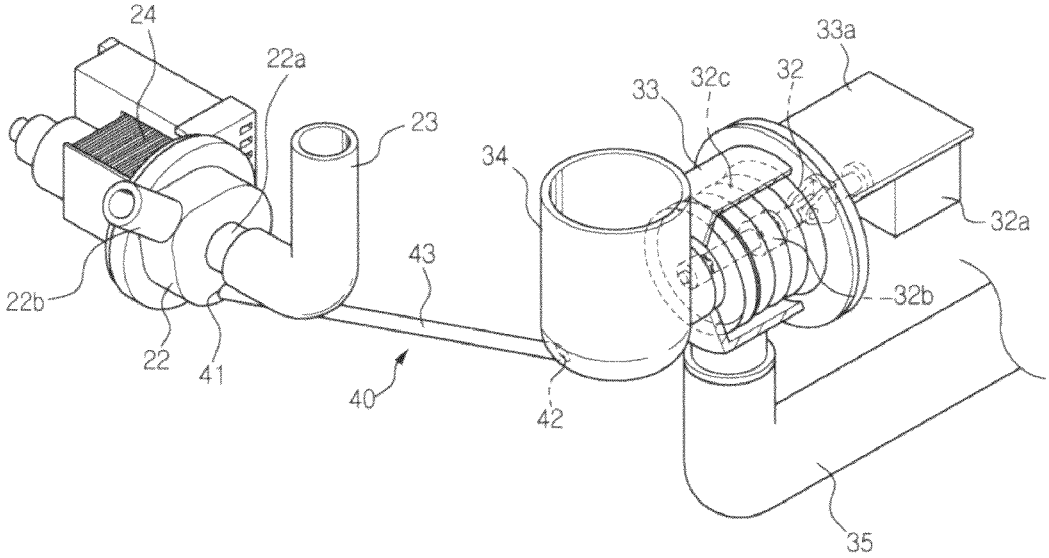
FIG. 3 is a perspective view showing the structure of the automatic washing machine according to the embodiment of FIG. 1.

FIGS. 2 and 3 are perspective views showing the structure of the automatic washing machine according to the embodiment of FIG. 1.

Referring to FIGS. 2 and 3, the circulation passage 20 includes a guide passage, a circulation pump 24, a pump case 22, and a discharge passage.

The guide passage includes a washing water inlet port 21, a case inlet port 22*a*, and an inlet pipe 23. The washing water inlet port 21 protrudes downward from the bottom surface of the water tub 8. The case inlet port 22*a* protrudes from a side surface of the pump case 22 in a horizontal direction such that washing water can be introduced into the pump case 22. The inlet pipe 23 couples the washing water inlet port 21 with the case inlet port 22*a*. The circulation pump 24 is coupled with the pump case 22 in opposition to the case inlet port 22*a*. One side of the circulation pump 24 is fixed to a fixing plate 8*a* provided at the lower portion of the water tub 8. The discharge passage includes a case outlet port 22*b* and a discharge pipe 25 such that washing water pumped by the circulation pump 24 is discharged. The case outlet port 22*b* protrudes upward from a top surface of the pump case 22. The discharge pipe 25 is coupled with the case outlet port 22*b*.

When the circulation pump 24 operates in a washing process, water contained in the water tub 8 is introduced into the pump case 22 through the guide passage, and the water pumped by the circulation pump 24 mounted on the pump case 22 is introduced to an upper portion of the water tub 8 along the discharge passage, so that the water is dropped into the rotating tub 9.

The operation of the circulation pump 24 is stopped when the washing process has been finished, and washing water of the water tub 8 is drained to the outside of the drain line 30. Since the drain line 30 is spaced apart from the circulation passage 20, the drain line 30 is spaced apart from the pump case 22 installed in the circulation passage 20. The drain line 30 is coupled with a washing water drain port 31 provided at the lower portion of the water tub 8, and provided thereon with a drain valve 32 to open/close the drain line 30.

The drain valve 32 is installed in the drain line 30 in a horizontal direction. In this case, the drain line 30 is provided at an upper portion thereof with a drain box 33 used to install the drain valve 32. The drain line 30 is divided into a front drain line 34 and a rear drain line 35 about the drain box 33. The front drain line 34 allows washing water to be introduced into the drain box 33. The rear drain line 35 allows washing water to be drained out of the drain box 33. The front drain line 34 is horizontally connected to the side surface of the drain box 33, and the rear drain line 35 is vertically connected to a bottom surface of the drain box 33.

Figure 4:
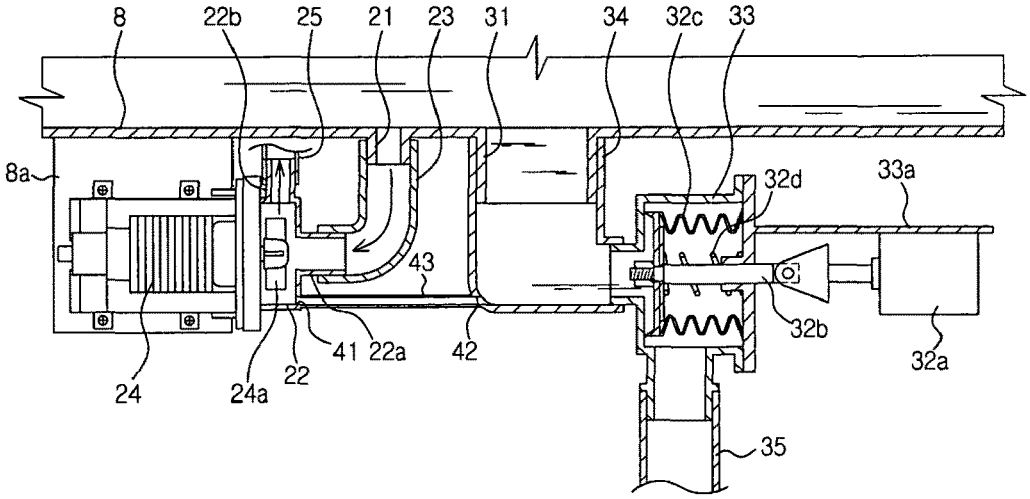
FIG. 4 is a sectional view showing the flow of washing water in a washing process of the automatic washing machine according to the embodiment of FIG. 1.

The drain valve 32 includes an operational rod 32*b*, a bellows-type opening/closing member 32*c*, and a tension spring 32*d* (see FIG. 4). The operational rod 32*b* reciprocates by an electromagnet 32*a*. The bellows-type opening/closing member 32*c* is coupled with the operational rod 32*b*, and horizontally installed in the drain box 33. The tension spring 32*d* is installed in the bellows-type opening/closing member 32*c* to prevent the bellows-type opening/closing member 32*c* from being opened due to the water pressure of a washing machine.

Therefore, in a washing process, the drain line 30 maintains a closed state by the bellows-type opening/closing member 32*c* installed in the drain box 33. In addition, when the discharge of washing water is started after the washing process has been finished, the operational rod 32*b* moves backwards by the electromagnet 32*a* while the bellows-type opening/closing member 32*c* cooperating with the operational rod 32*b* is moving backwards, so that the drain line 30 is open. The electromagnet 32*a* is fixed to a fixing plate 33*a* to reciprocate the operational rod 32*b*, and the fixing plate 33*a* protrudes from an upper side surface of the drain box 33 in a horizontal direction.

The remaining water discharge passage 40 is formed to connect the inner part of the pump case 22 with the drain line 30 such that water remaining in the pump case 22 is discharged after the operation of the circulation pump 24 has been stopped.

The remaining water discharge passage 40 includes a first remaining water discharging port 41, a second remaining water discharging port 42, and a remaining water discharging pipe 43. The first remaining water discharging port 41 is formed at a lower portion of the opposite side surface of the side surface coupled with the circulation pump 24 in the pump case 24, and the second remaining water discharging port 42 is formed at one side of the front drain line 34. The remaining water discharging pipe 43 connects the first remaining water discharging port 41 with the second remaining water discharging port 42 such that the drain line 30 communicates with the inner part of the pump case 22.

Since the first remaining water discharging port 41 is formed at the lower portion of the side surface of the pump case 22, the washing water can be prevented from being discharged to the remaining water passage 40 when an impeller 24*a* (see FIG. 4) of the circulation pump 24 is rotated during the operation of the circulation pump 24. In addition, when the drain valve 32 is open after the operation of the circulation pump 24, washing water remaining in the pump case 22 can be completely drained through the remaining water discharge passage 40.

Further, since the second remaining water discharging port 42 is formed at one side of the front drain line 34, water circulating through the inner part of the pump case 22 can be prevented from being delivered to the drain line 30 through the remaining water discharge passage 40. This is because the drain line 30 is closed by the drain valve 32 when the circulation pump 24 operates so that washing water is filled in the front drain line 34. Accordingly, the second remaining water discharging port 42 is formed at one side of the front drain line 34, thereby preventing the pumping performance of the circulation pump 24 from being degraded when the circulation pump 24 operates.

The remaining water discharging pipe 43 connecting the first remaining water discharging port 41 with the second remaining water discharging port 42 maintains a horizontal state or is declined from the pump case 22 to the front drain line 34 so that remaining water of the pump case 22 is delivered to the front drain line 34 when the washing water is discharged. Accordingly, the second remaining water discharging port 42 has to be formed in a line with the first remaining water discharging port 41, or be lower than the first remaining water discharging port 41. According to the embodiment, the second remaining water discharging port 42 is formed in a line with the first remaining water discharging port 41 so that the remaining water discharging pipe 43 can maintain a horizontal state.

As shown in FIGS. 2 and 3, the pump case 22, the remaining water discharge passage 40, and the front drain line 34 are integrated with each other by taking into consideration the installation position of the pump case 22 and the front drain line 34 and the gradient of the remaining water discharge passage 40.

Figure 5:
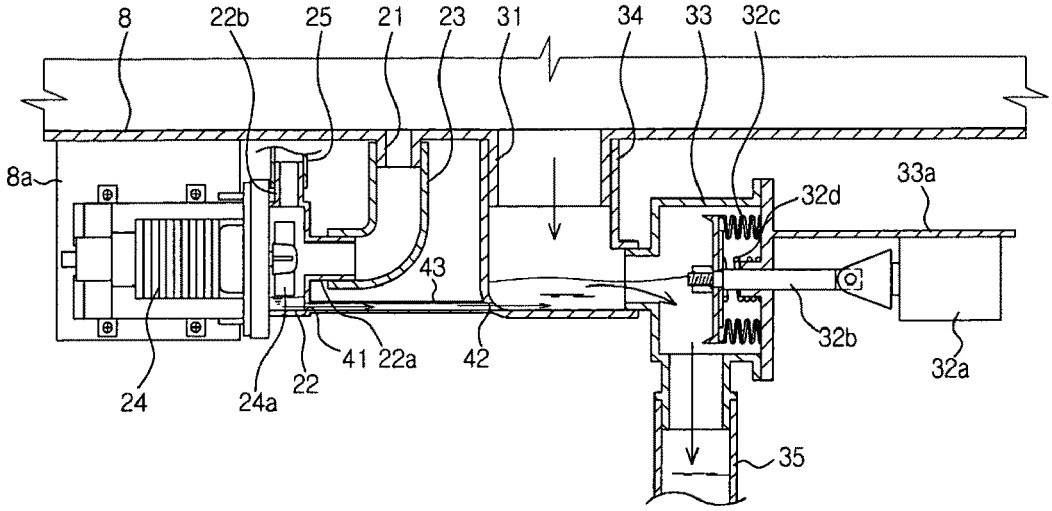
FIG. 5 is a sectional view showing the flow of washing water when washing water is drained in the automatic washing machine according to the embodiment of FIG. 1.

FIG. 4 is a sectional view showing the flow of washing water in a washing process of the automatic washing machine according to the embodiment of FIG. 1, and FIG. 5 is a sectional view showing the flow of washing water when the washing water is discharged in the automatic washing machine according to the embodiment of FIG. 1.

Hereinafter, the operation of the automatic washing machine according to the embodiment will be described with reference to FIGS. 4 and 5.

When laundry is put into the automatic washing machine, and washing water is introduced into the water tub 8 from the water supply device 7, a washing process is started.

If the washing process is started, the circulation pump 24 circulates washing water contained in the water tub 8. In this case, since the drain valve 32 of the drain line 30 is closed, the front drain line 34 is filled with washing water. Accordingly, as shown in FIG. 4, washing water circulating in the pump case 22 is not delivered to the front drain line 34 along the remaining water discharge passage 40, so that the pumping performance of the circulation pump 24 is not degraded.

After the washing process has been finished, the circulation pump 24 is stopped. Then, the drain line 30 is open so that washing water is discharged. As shown in FIG. 5, since the circulation pump 24 is stopped, washing water does not circulate through the circulation passage 20 any more, and the washing water is discharged out of the water tub 8 along the drain line 30. Therefore, during the discharge of the washing water contained in the water tub 8, water remaining in the pump case 22 is delivered to the drain line 30 along the remaining water discharge passage 40 and discharged out of the automatic washing machine.

As described above, the automatic washing machine according to the embodiment of the present invention discharges water remaining in the pump case 22 to an exterior through the remaining water discharge passage 40 connecting the pump case 22 with the drain line 30 when the discharge of washing water is started after the circulation pump 24 has been stopped. Accordingly, it is possible to prevent the circulation pump 24 from being broken or getting out of order due to the freezing of water remaining in the pump case 22 in the winter season.

In addition, since the automatic washing machine according to the embodiment of the present invention has a structure in which washing water circulating in the pump case 22 is not delivered to the drain line 30 through the remaining water discharge passage 40 when the circulation pump 24 operates, the pumping performance of the circulation pump 24 is not degraded. Therefore, remaining water of the pump case 22 can be removed.

Figure 6:
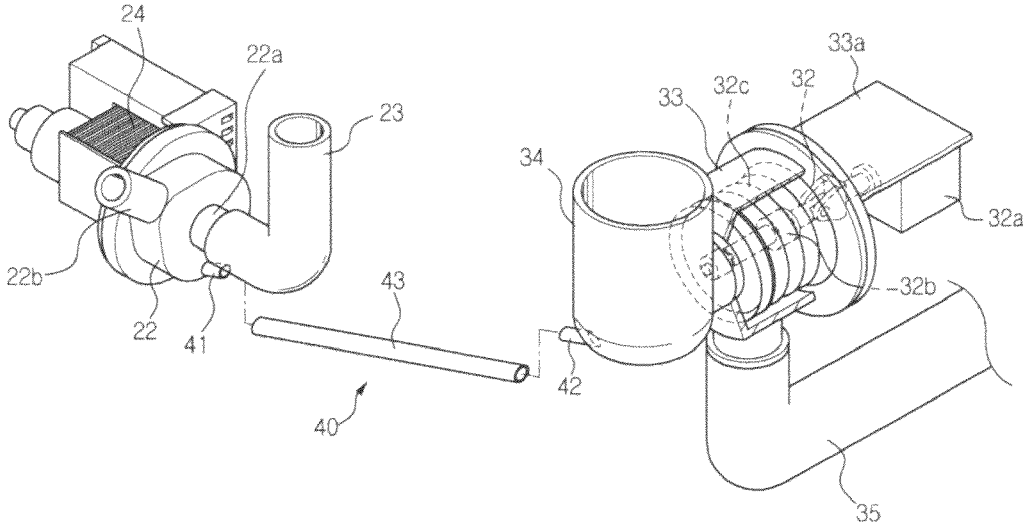
FIG. 6 is a perspective view showing the structure of the remaining water discharge passage of an automatic washing machine according to another embodiment of the present invention.

FIG. 6 is a perspective view showing the structure of a remaining water drain passage 40 of the automatic washing machine according to another embodiment.

As shown in FIG. 6, the remaining water discharge passage 40 includes the first remaining water discharging port 41, the second remaining water discharging port 42, and the remaining water discharging pipe 43. The first remaining water discharging port 41 protrudes outward from a lower portion of a side surface of the pump case 22 and has a cylindrical shape. The second remaining water discharging port 42 protrudes outward from one side of a front drain line 34 and has a cylindrical shape. The remaining water discharging pipe 43 connects both ends of the first and second remaining water discharging ports 41 and 42 with each other and has a cylindrical shape.

In other words, a pump case 22 provided with the first remaining water discharging port 41, a front drain line 34 provided with the second remaining water discharging port 42, and the remaining water discharging pipe 43 are separately manufactured, and the remaining water discharging pipe 43 is connected with the first and second remaining water discharging ports 41 and 42.

The first and second remaining water discharging ports 41 and 42 have the same diameter. An inner diameter of the remaining water discharging pipe 43 is equal to or slightly smaller than the outer diameter of the first and second remaining water discharging ports 41 and 42, such that both ends of the remaining water discharging pipe 43 are press-fitted into the first and second remaining water discharging ports 41 and 42.

Although not shown in drawings, threads are formed around the first and second remaining water discharging ports 41 and 42, and screw grooves are formed at inner surfaces of both ends of the remaining water discharging pipe 43 so that the first and second remaining water discharging ports 41 and 42 are screwed with the remaining water discharging pipe 43.

Although few embodiments have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a water tub;

a pump case;

a circulation pump coupled with the pump case that circulates washing water contained in the water tub;

a circulation line to circulate the washing water contained in the water tub;

a drain line to drain the washing water contained in the water tub, the drain line being separated from the circulation line; and a remaining water discharge passage connecting an inner part of the pump case with the drain line to discharge water remaining in the pump case.

2. The washing machine of claim 1, wherein the remaining water discharge passage includes a first remaining water discharging port formed at one side of the pump case, a second remaining water discharging port formed at one side of the drain line, and a remaining water discharging pipe connecting the first and second remaining water discharging ports with each other.

3. The washing machine of claim 2, wherein the first remaining water discharging port is formed at a lower portion of the pump case.

4. The washing machine of claim 3, wherein the first remaining water discharging port is formed at a side surface of the pump case.

5. The washing machine of claim 2, wherein the second remaining water discharging port is lower than the first remaining water discharging port.

6. The washing machine of claim 5, wherein the circulation pump is fixed to a lower portion of the water tub.

7. The washing machine of claim 1, further comprising a drain valve installed in the drain line to open/close the drain line, the drain line including a front drain line connecting the water tub to the drain valve and a rear drain line connecting the drain valve to an exterior of the washing machine.

8. The washing machine of claim 7, wherein the second remaining water discharging port is formed at one side of the front drain line.

9. The washing machine of claim 8, wherein the pump case, the remaining water discharge passage, and the front drain line are integrated with each other.

10. The washing machine of claim 1, wherein the remaining water discharge passage is declined from the pump case to the drain line.

11. The washing machine of claim 10, wherein the circulation pump is fixed to a lower portion of the water tub.

* * * * *